US011248503B2

(12) United States Patent
Hedman

(10) Patent No.: US 11,248,503 B2
(45) Date of Patent: Feb. 15, 2022

(54) ELECTRICALLY ACTIVATED VALVE ACTUATOR FOR AN INTERNAL COMBUSTION ENGINE

(71) Applicant: Hedman Ericsson Patent AB, Flen (SE)

(72) Inventor: Mats Hedman, Sparreholm (SE)

(73) Assignee: Hedman Ericsson Patent AB, Flen (SE)

( * ) Notice: Subject to any disclaimer, the term of this patent is extended or adjusted under 35 U.S.C. 154(b) by 0 days.

(21) Appl. No.: 17/262,020

(22) PCT Filed: Jul. 29, 2019

(86) PCT No.: PCT/SE2019/050713
§ 371 (c)(1),
(2) Date: Jan. 21, 2021

(87) PCT Pub. No.: WO2019/245450
PCT Pub. Date: Dec. 26, 2019

(65) Prior Publication Data

US 2021/0246814 A1 Aug. 12, 2021

(30) Foreign Application Priority Data

Jul. 31, 2018 (SE) ..... 1800146-1

(51) Int. Cl.
*F01L 9/21* (2021.01)
*F01L 1/38* (2006.01)
(Continued)

(52) U.S. Cl.
CPC ..... *F01L 9/21* (2021.01); *F01L 1/38* (2013.01); *F01L 1/462* (2013.01);
(Continued)

(58) Field of Classification Search
CPC ..... F01L 1/46; F01L 1/462; F01L 9/20; F01L 9/21; F01L 2009/4086; F01L 2009/4098; F01L 2820/031
(Continued)

(56) References Cited

U.S. PATENT DOCUMENTS 4,602,233 A 7/1986 Pavlovsky et al.
6,082,315 A * 7/2000 Schneider ..... F01L 9/20 123/90.11
(Continued)

FOREIGN PATENT DOCUMENTS

CN 1740525 A 3/2006
DE 19938297 A1 10/2020
EP 1241324 A1 9/2002

OTHER PUBLICATIONS

International Search Report and Written Opinion regarding Appl. No. PCT/SE2019/050713, dated Dec. 26, 2019, 11 pps.

*Primary Examiner* — Jorge L Leon, Jr.
(74) *Attorney, Agent, or Firm* — Foley & Lardner LLP

(57) ABSTRACT

The present invention concerns a method and a device for electrically controlling a valve actuator in a two-stroke or four-stroke combustion engine where the actuator comprises a solenoid (A), a plunger (5) and a spring (6), wherein the engine has at least one cylinder (1) with at least one freely controllable engine valve disc (10) with corresponding valve stem (11) and a valve spring (4), where a distance (7) is provided between the lower end of the plunger and the upper end of the valve stem and where air is supplied, or exhaust gases are evacuated from, a combustion chamber (3) past a lower part of the valve stem with the valve disc via at least one channel (2) in the cylinder, wherein the valve actuator is activatable to open the engine valve. The invention is characterized in that the opening of the engine valve is initiated after activation of the solenoid, wherein the fol-
(Continued)

lowing acceleration of the plunger brings its lower end to strike the upper end of the valve stem for initial opening of the valve.

7 Claims, 14 Drawing Sheets

(51) Int. Cl.
*F01L 9/40* (2021.01)
*F01L 1/46* (2006.01)

(52) U.S. Cl.
CPC ..... *F01L 2009/2126* (2021.01); *F01L 2009/2134* (2021.01); *F01L 2009/4086* (2021.01); *F01L 2009/4098* (2021.01); *F01L 2820/031* (2013.01)

(58) Field of Classification Search
USPC ..... 123/90.11, 90.65, 90.67
See application file for complete search history.

(56) References Cited

U.S. PATENT DOCUMENTS

| | | | | |
|---|---|---|---|---|
| 6,247,432 | B1 * | 6/2001 | Pischinger ..... | F01L 9/20 123/90.11 |
| 6,581,555 | B1 | 6/2003 | Abele et al. | |
| 2005/0172925 | A1 * | 8/2005 | Kurosawa ..... | F01L 1/18 123/188.17 |
| 2010/0024749 | A1 | 2/2010 | Meisel | |

* cited by examiner

ELECTRICALLY ACTIVATED VALVE ACTUATOR FOR AN INTERNAL COMBUSTION ENGINE

The present invention relates to a method and an arrangement in a freely controllable electrically activated valve actuator for controlling and regulating the gas flow in two- or four-stroke engines.

Freely controllable valves allow increased efficiency and substantially lower emissions, i.e. cleaner exhaust gas. Valve actuators can also be pneumatically or hydraulically activated.

The object of the invention is to provide a new actuator technology. An electrically controlled electromechanical valve actuator which is simple in its construction, energy efficient and which is capable of quickly opening and closing an engine valve in the cylinder head of an engine. This object is achieved by the invention by means of the features specified in the patent claims.

The technology involves using a solenoid and an engine valve spring which in a conventional manner keeps the valve closed and using a here called "hammer effect" when the engine valve is to be opened.

A known problem when using solenoids for opening engine valves is that they need to be strong to overcome the force of the mechanical spring, the engine valve spring, which keeps the valve closed. One disadvantage with high strength is that the moving iron core, the plunger, which shall overcome the closing force of the engine valve spring, becomes large and heavy. The weight of the iron core and the valve spring together with the force of the valve spring prevent the possibility for a short duration, i.e. a short time from that the valve is closed until it is fully open and then closed again. The present invention is characterized in that the mass of the iron core is mostly not involved during the duration. Since the iron core is mostly not part of the movement of the engine valve, a significantly short duration is made possible. The technology makes use of the weight of the iron core and turns this known disadvantage into an advantage, the "hammer effect".

The invention will now be described with reference to shown embodiments, where FIGS. 1-14 schematically shown embodiments where a computer based engine control system with required sensors for detecting crank angle degree and electronics for reading crank angle degree and controlling required solenoids and so on are considered already present and therefore do not need to be illustrated. It is furthermore not needed to show any spark plug or fuel injector, and the same applies to the combustion chamber surrounded by cylinder walls and piston.

FIG. 1 shows an initial position at turned-off engine and with a partially cut view from the side of a cylinder head 1 with a channel 2 for supplying air with or without fuel to, or evacuation of exhaust gases from, a combustion chamber 3 past a conventional valve disc 10. An engine valve consists of the valve disc with valve stem 11. The engine valve is held closed in a conventional manner using a spring 4 and a conventional spring washer 8 holds the spring in place with a certain pretension. Further shown is a solenoid A with an iron core or plunger 5. A spring 6 retains the plunger 5 in a home position when the solenoid A is not activated. There is a distance 7, also referred to as an acceleration distance, between an upper end of the valve stem 11 and a lower end of the plunger 5. Although not illustrated in the figure, it is understood that the plunger has a large mass. When the plunger is wholly or partially present in the solenoid, the portion of the plunger being in the solenoid is surrounded by a winding of copper wire. When electricity is fed to the winding, a magnetic field is generated which attracts or repels the plunger. In this case, the plunger is attracted by the surrounding magnetic field, but the opposite could be the case while still being within the scope of the invention. A plunger is provided with an existing stop in the solenoid, being a natural stop where its force is at its maximum. Although not illustrated, it is understood that such a stop is present.

FIG. 2 shows the engine valve in a still closed position, for instance before the engine is started. The solenoid A has been activated and the plunger 5 has been accelerated while moving along distance 7 to the point where it hits the upper end of valve stem 11, whereby the kinetic energy of the plunger almost instantaneously is transferred to the valve stem, the "hammer effect".

FIG. 3 shows the engine valve at the onset of an opening movement. The plunger has transferred most of its kinetic energy to the engine valve, whose movement towards an open position is undergoing heavy acceleration. The movement of the plunger continues for another short distance until the plunger reaches its natural stop in the solenoid.

FIG. 4 shows the engine valve in fully open position where it turns. It is apparent that the only moving mass in this stage is the lowest possible mass consisting of the engine valve with its stem, spring washer and spring. The shortest possible duration is achieved. It is common that the moving mass of the spring is considered to constitute about one third of the spring weight.

Figure 1:
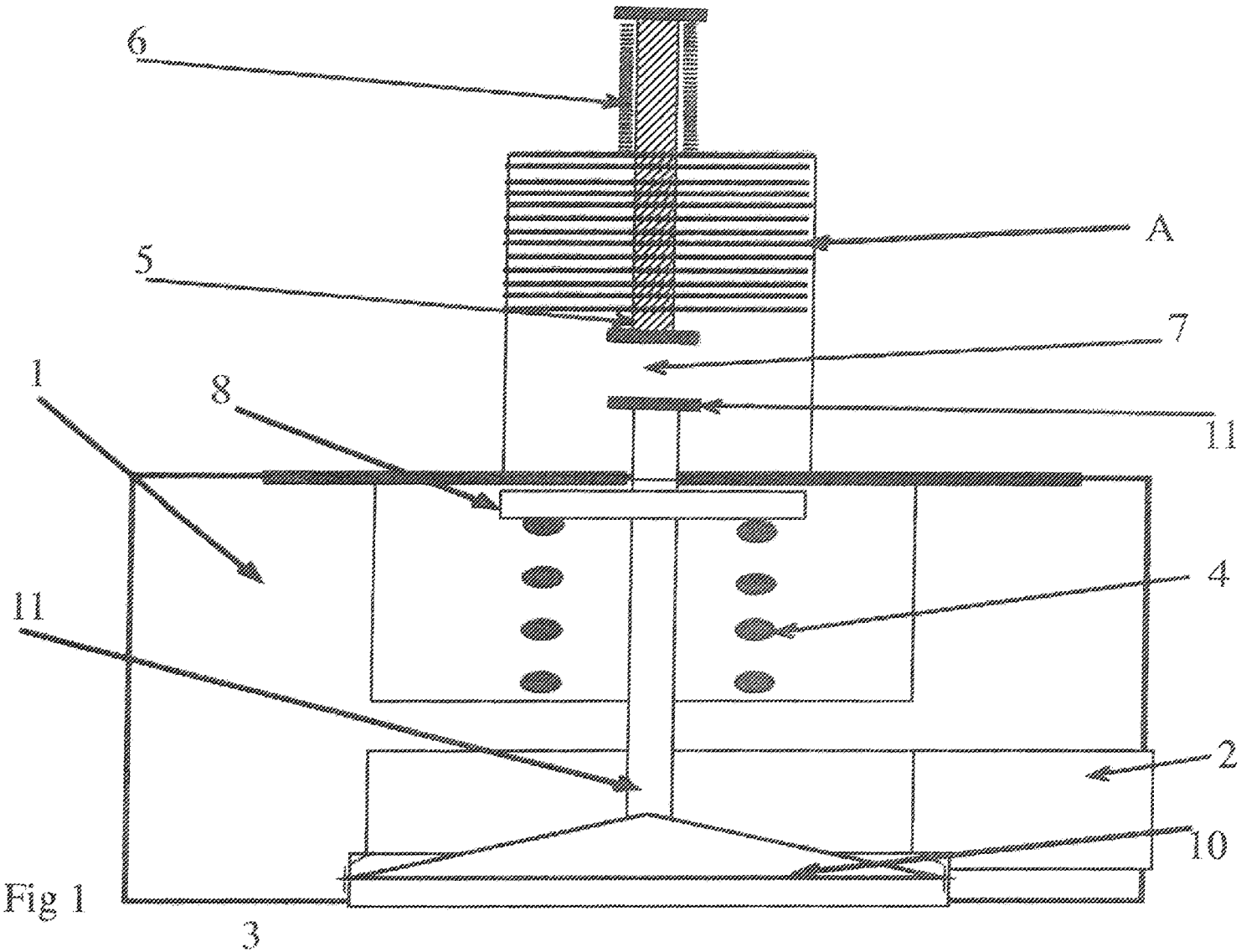
Figure 2:
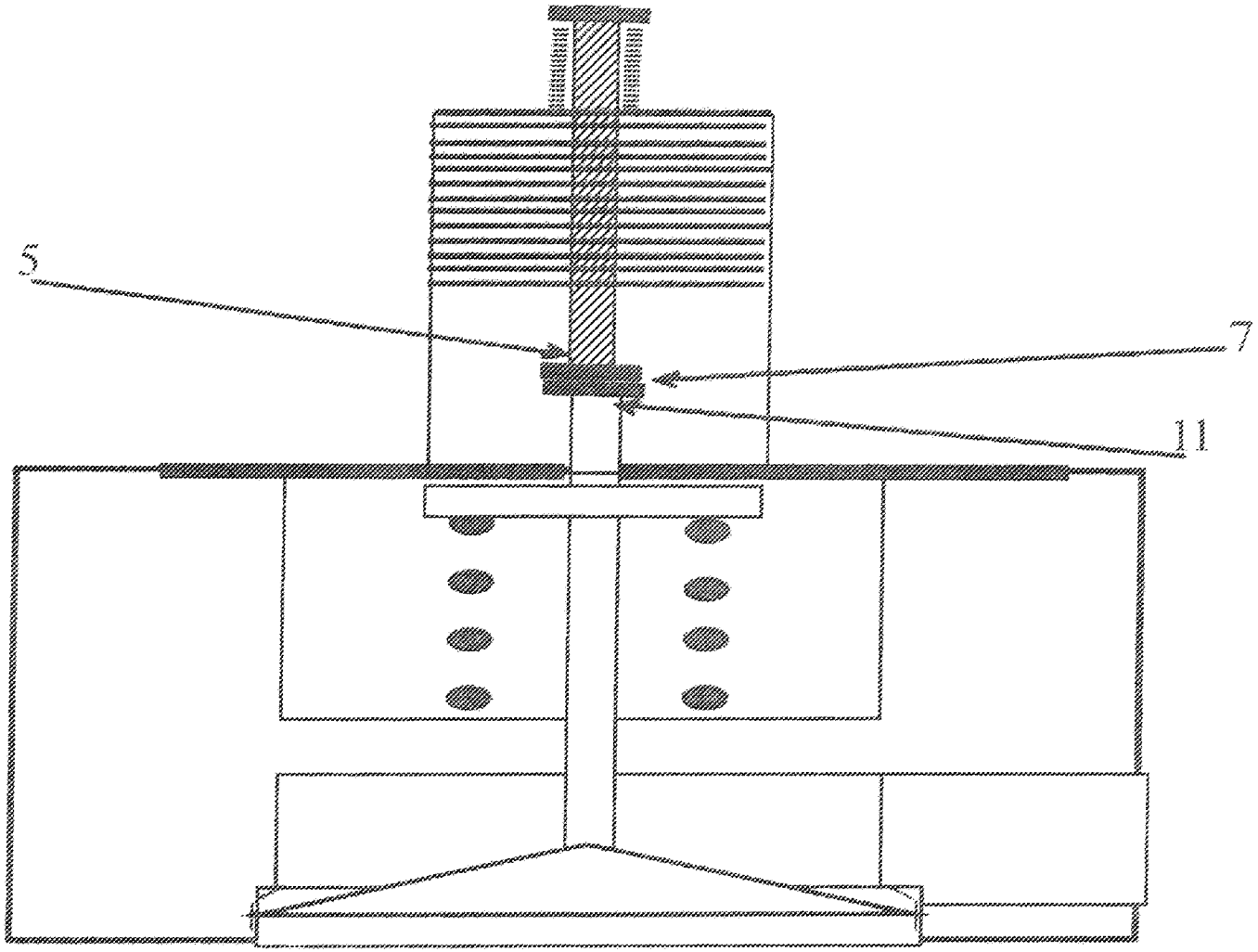
Figure 3:
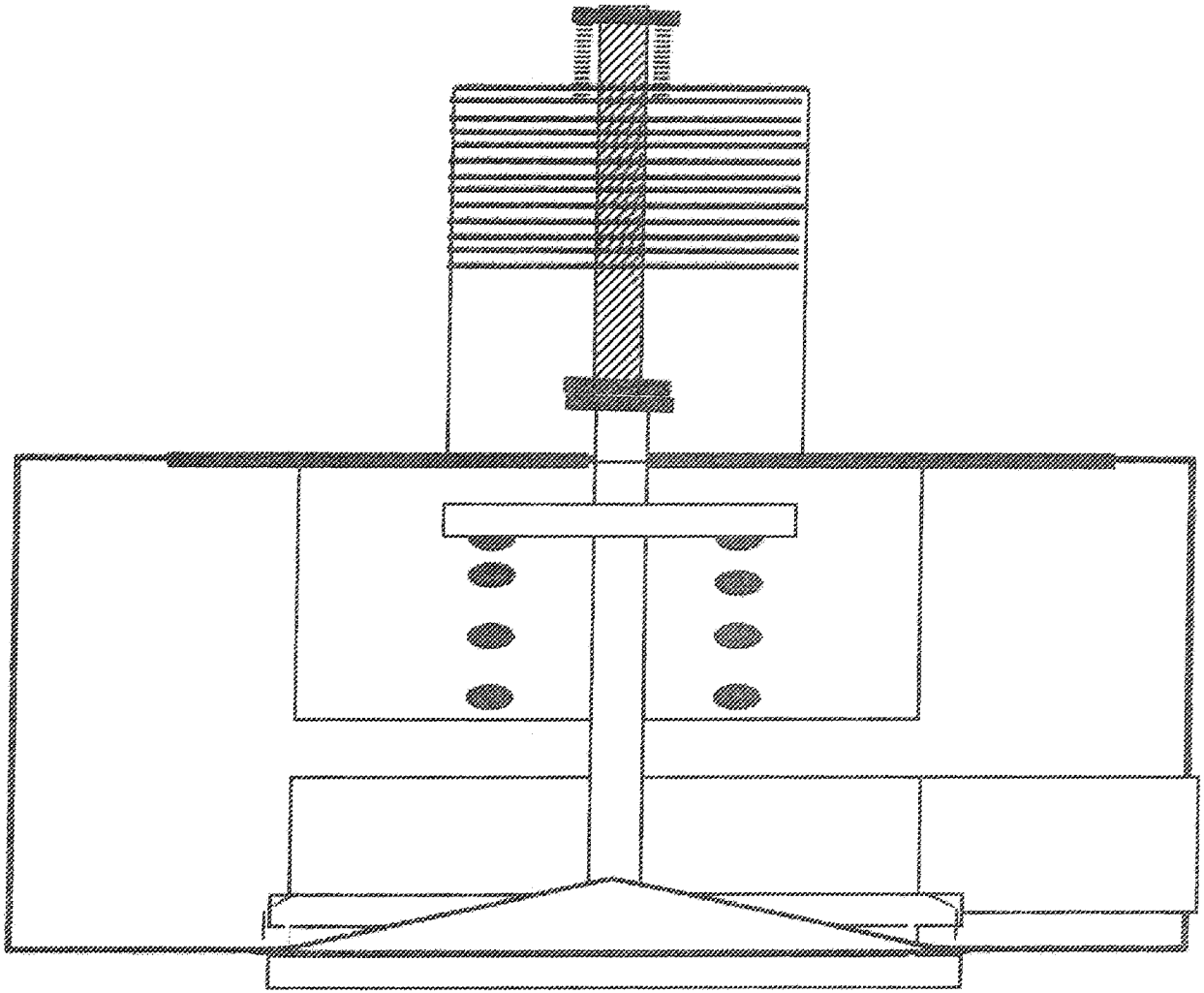
Figure 4:
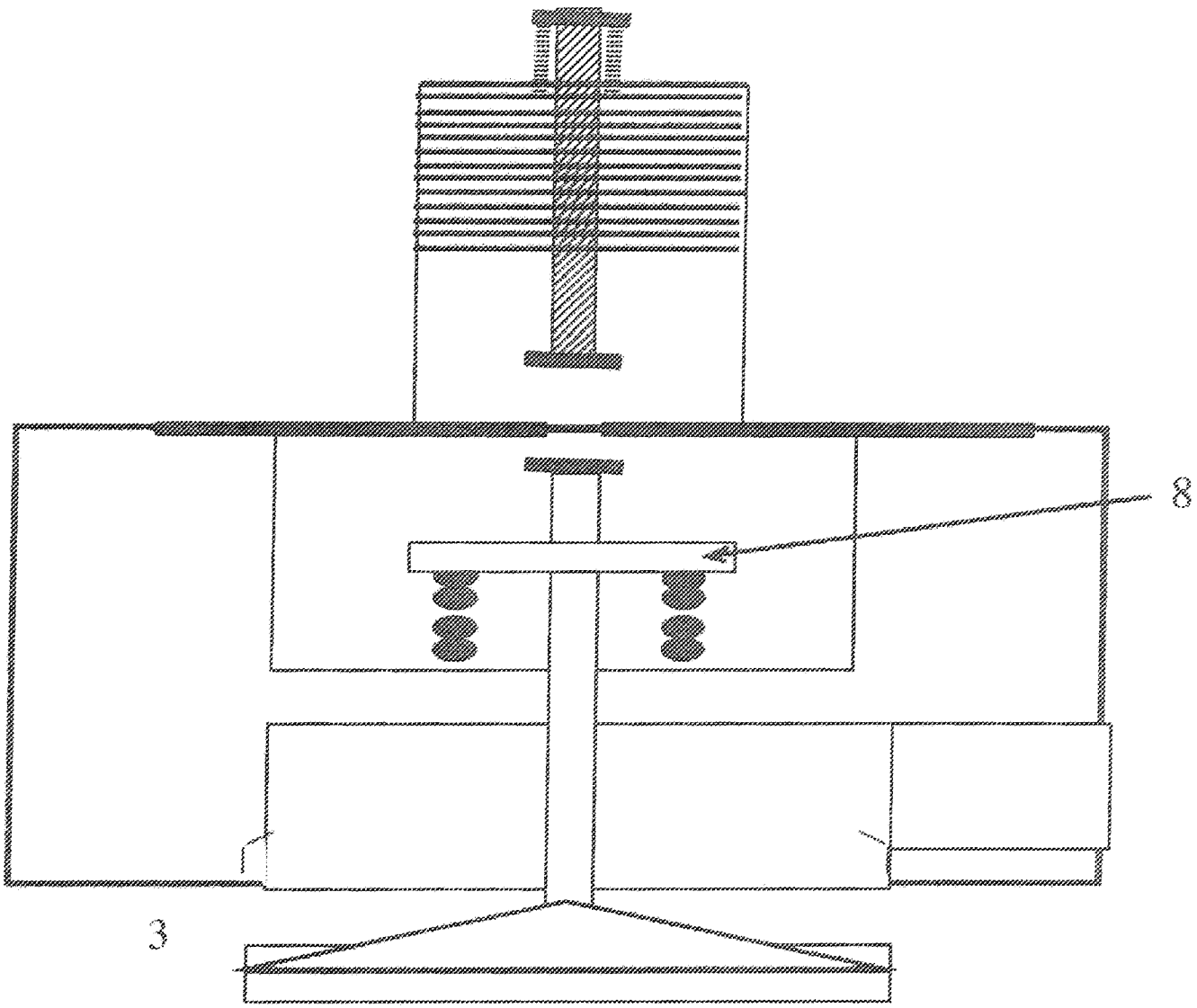
Figure 5:
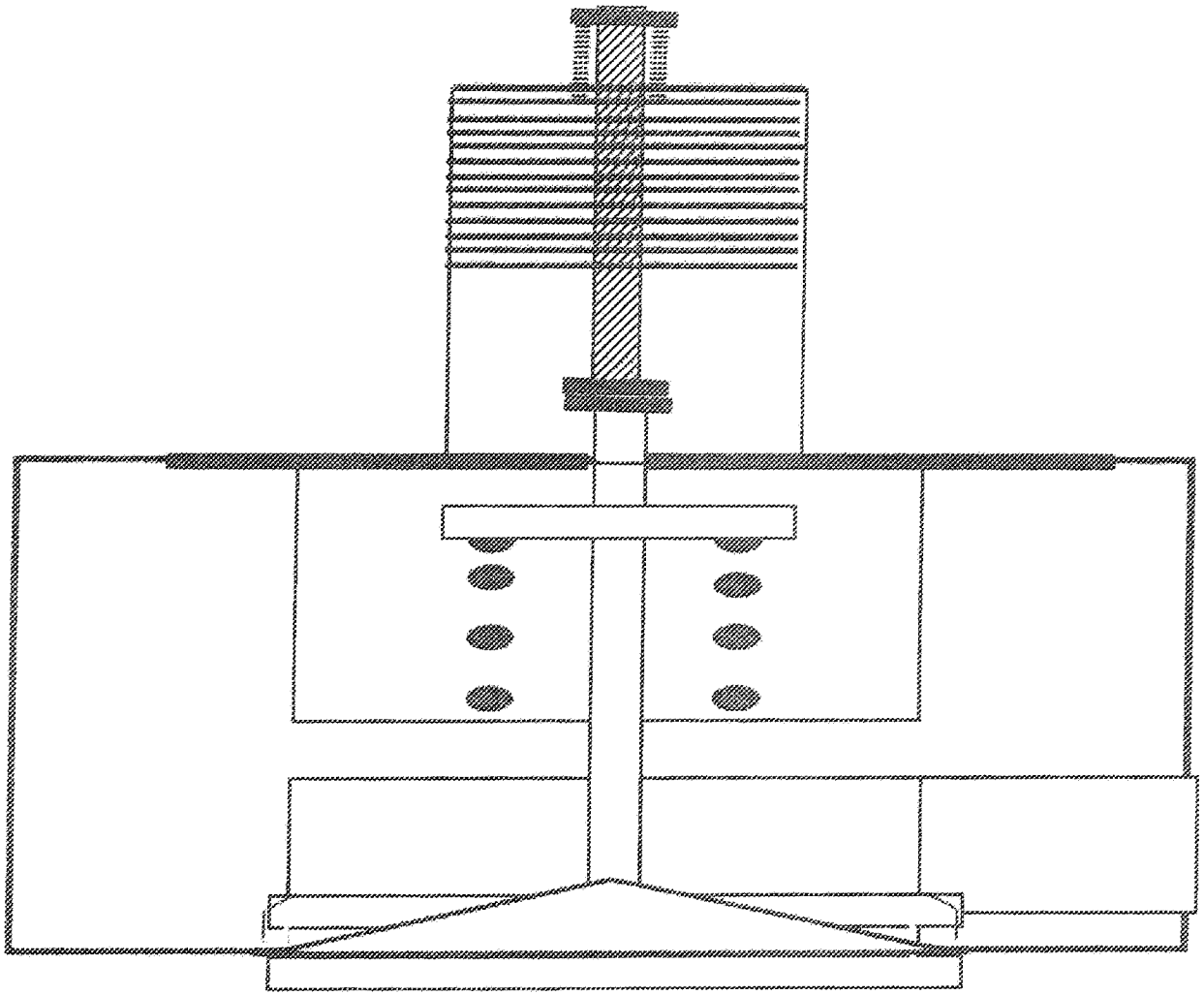
FIG. 5 shows that the engine valve stem reaches the plunger before or in an initial movement towards its initial position when the engine valve is to close the channel 2. A short adapted addition of energy to the solenoid brings the movement of the engine valve to retard whereby a soft return to the engine valve seat is made possible.
Figure 6:
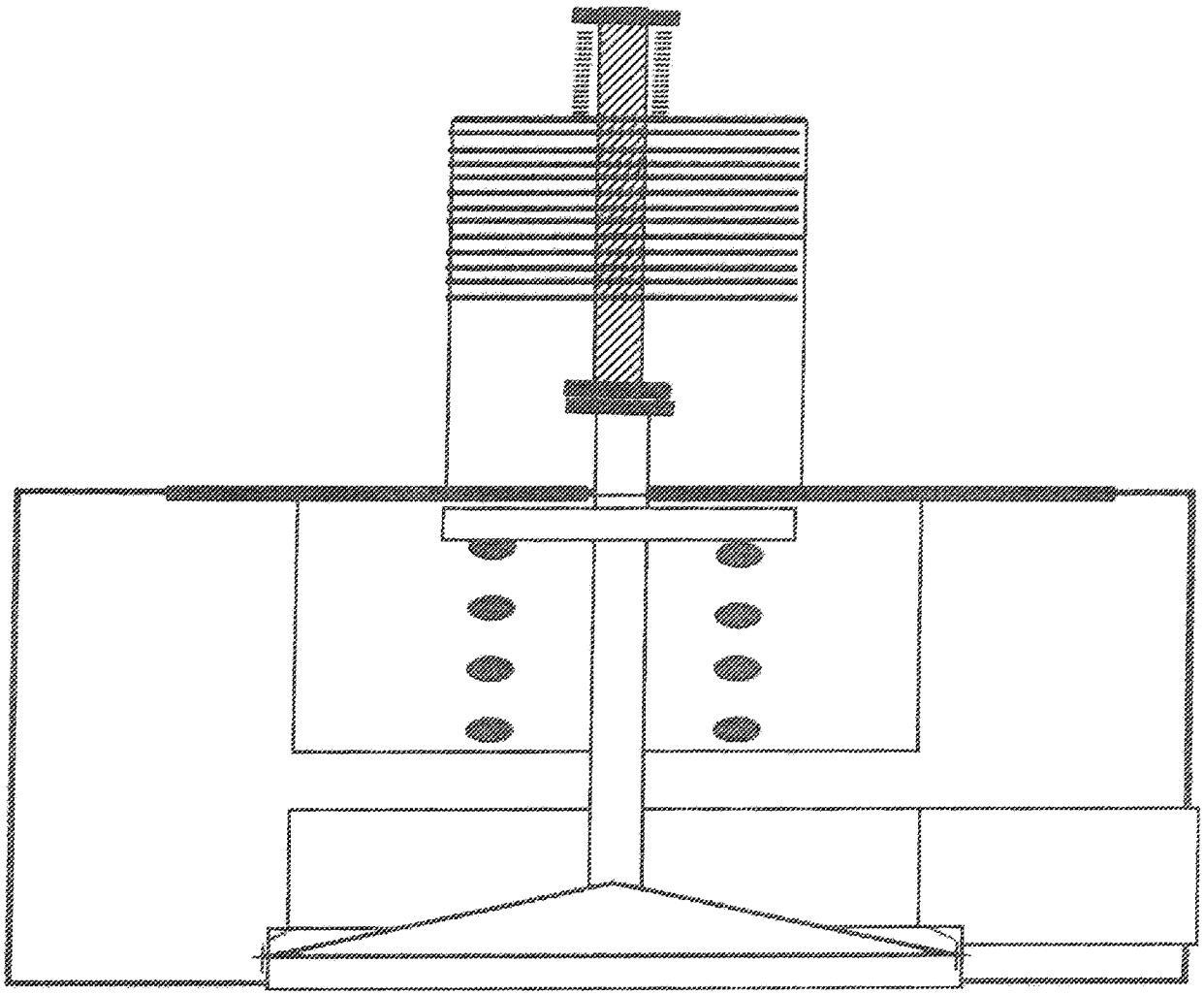
FIG. 6 shows the engine valve returned back to its initial position as shown in FIG. 1. The plunger is however still in contact with the valve stem.
Figure 7:
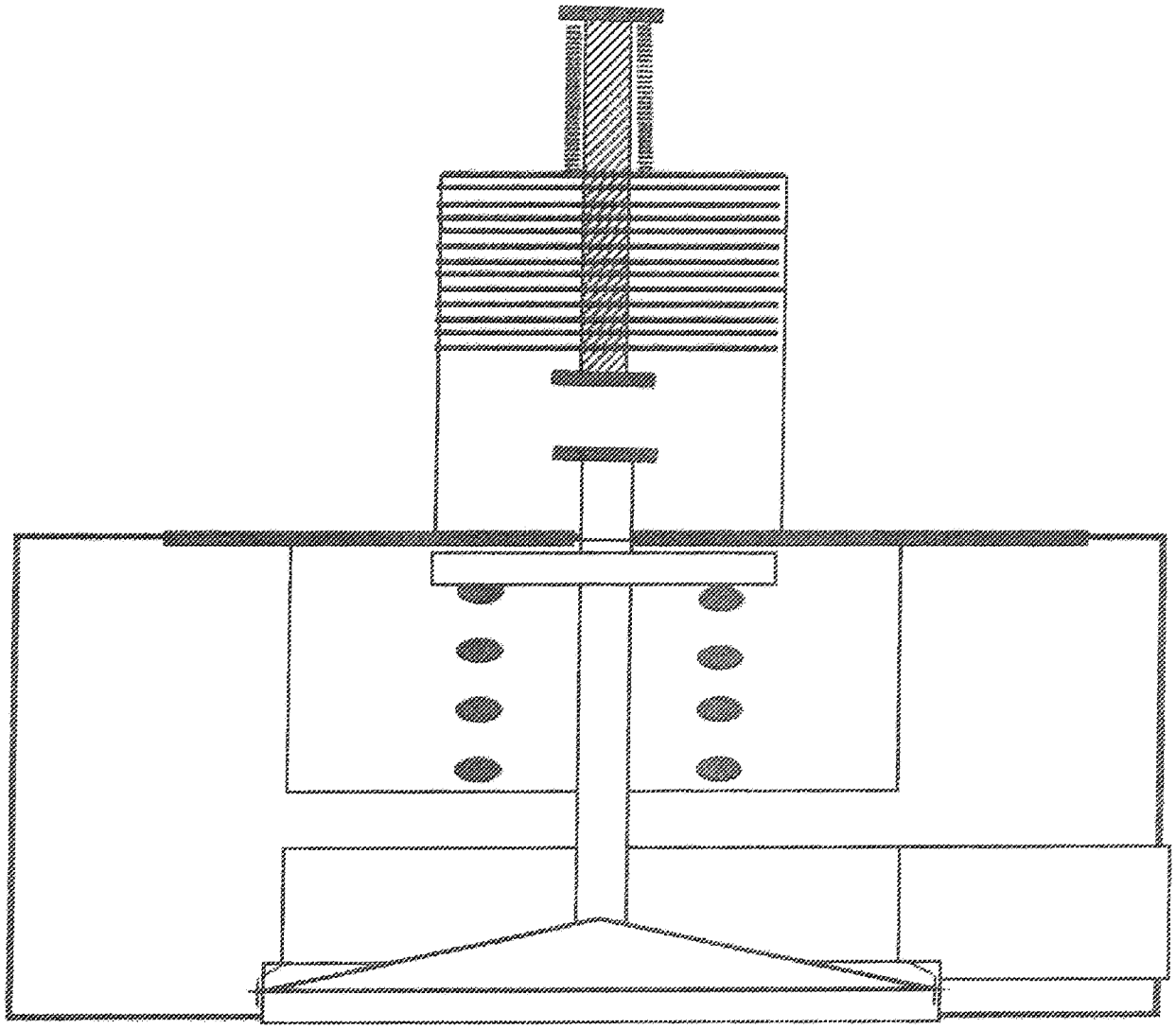
FIG. 7 shows that also the plunger is returned to its initial position with assistance from the spring 6.
Figure 8:
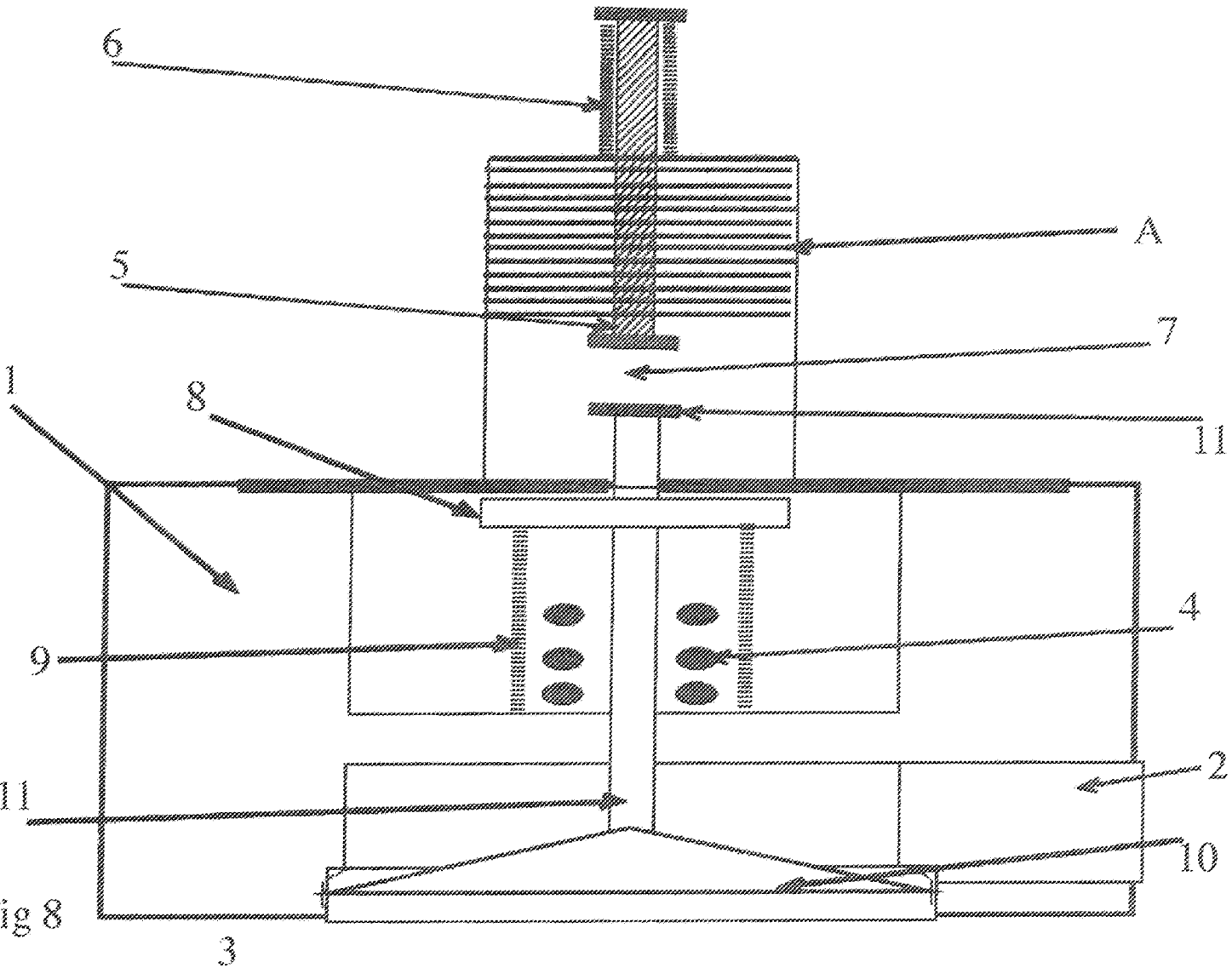
Figure 9:
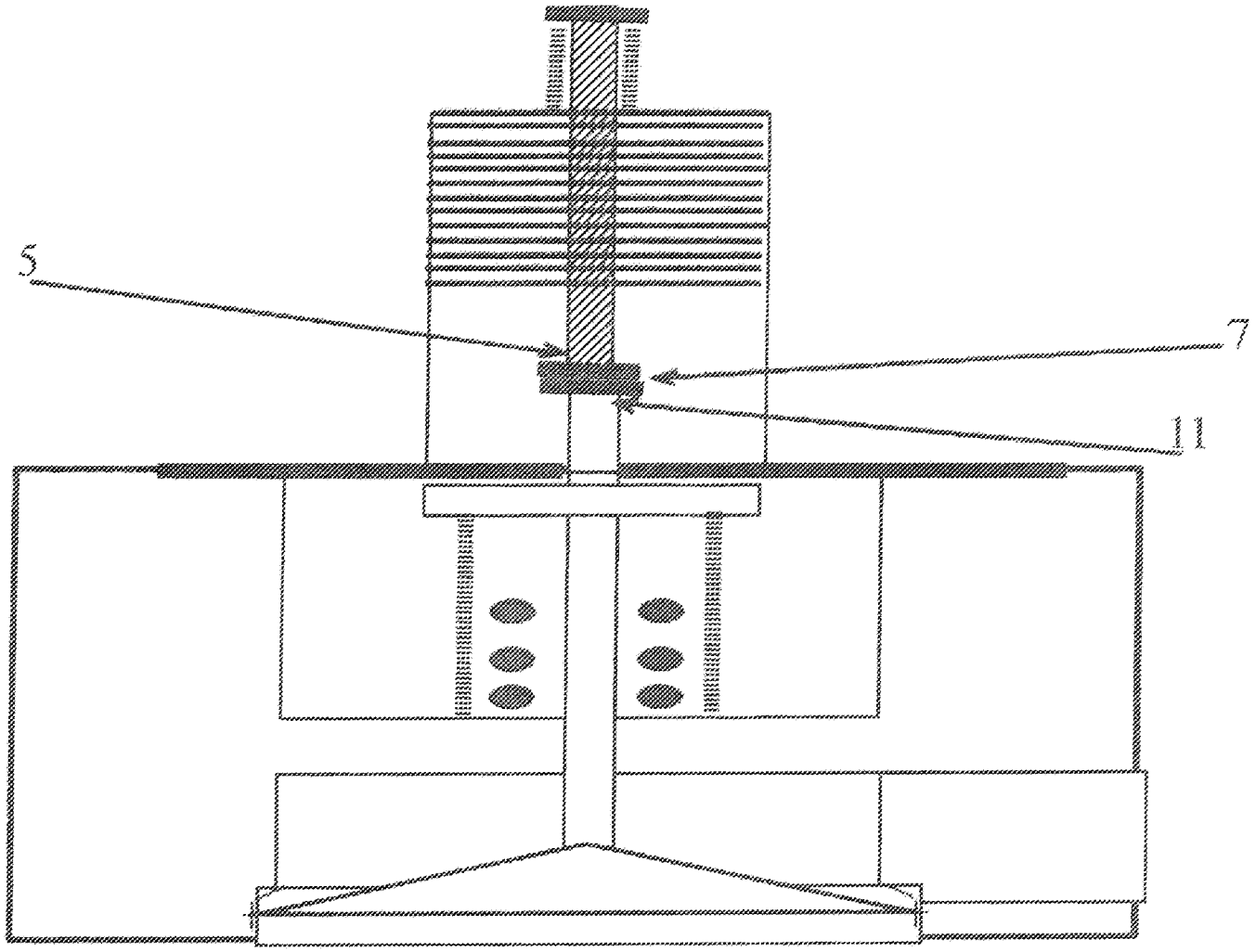
Figure 10:
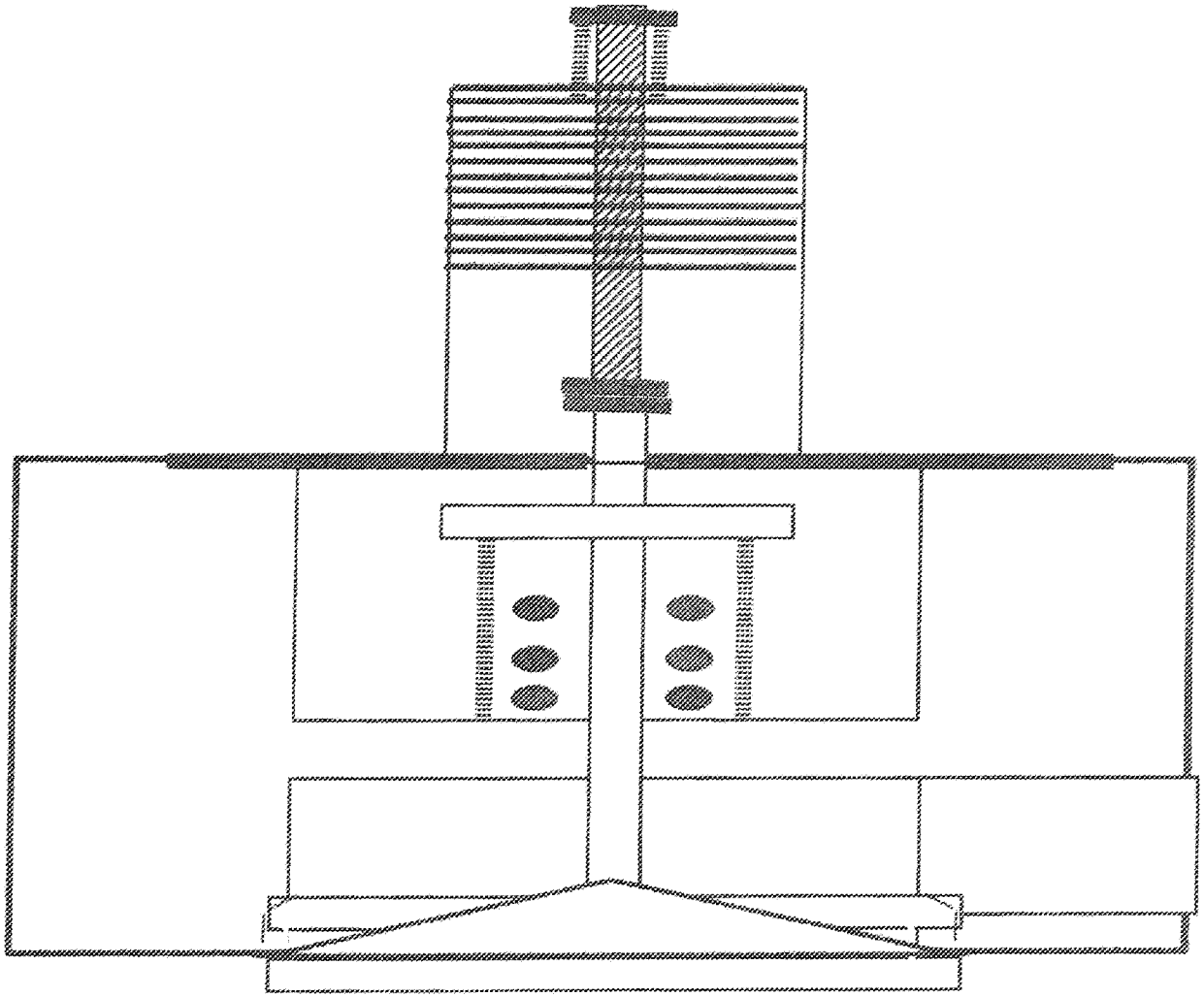
Figure 11:
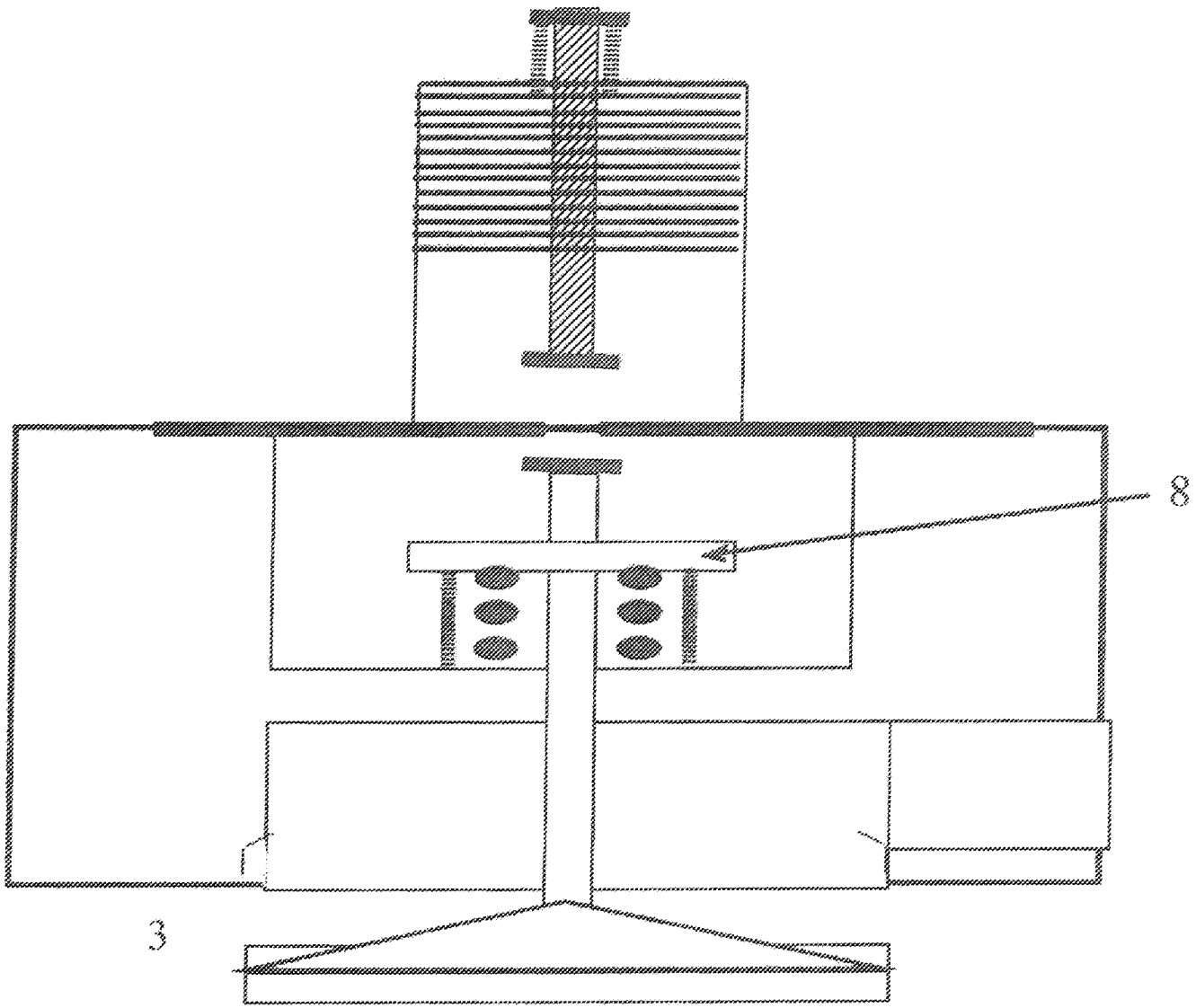
Figure 12:
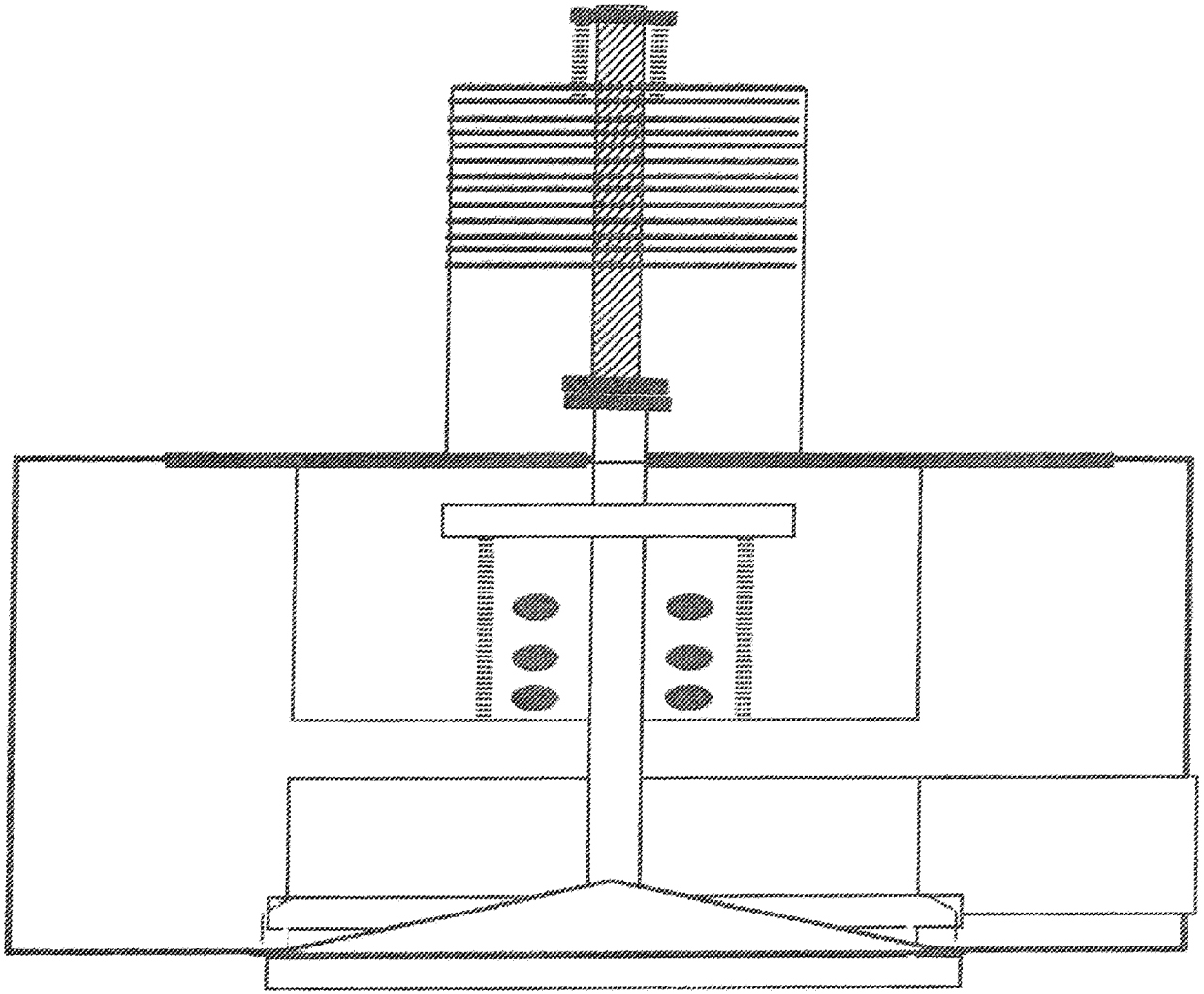
Figure 13:
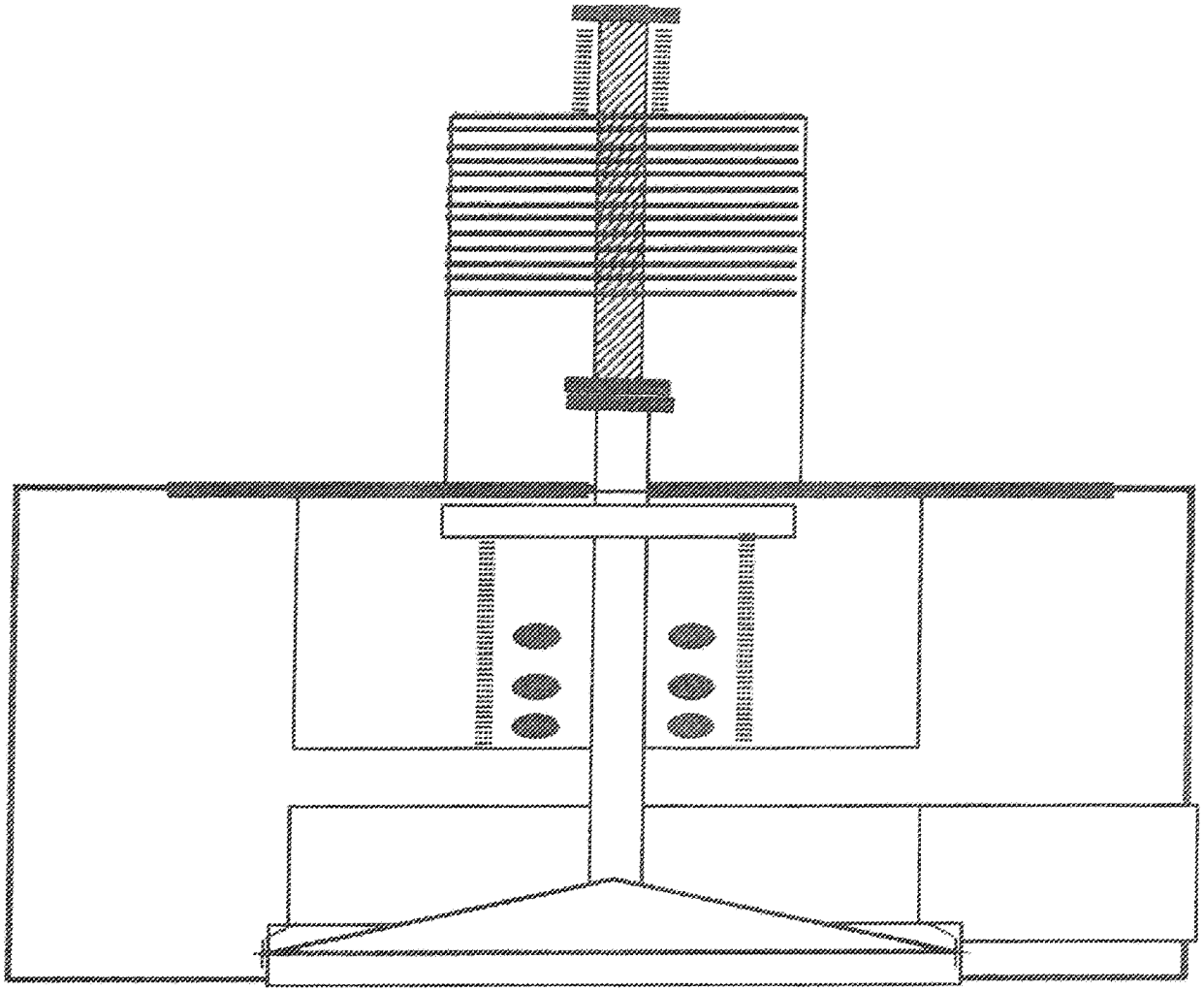
Figure 14:
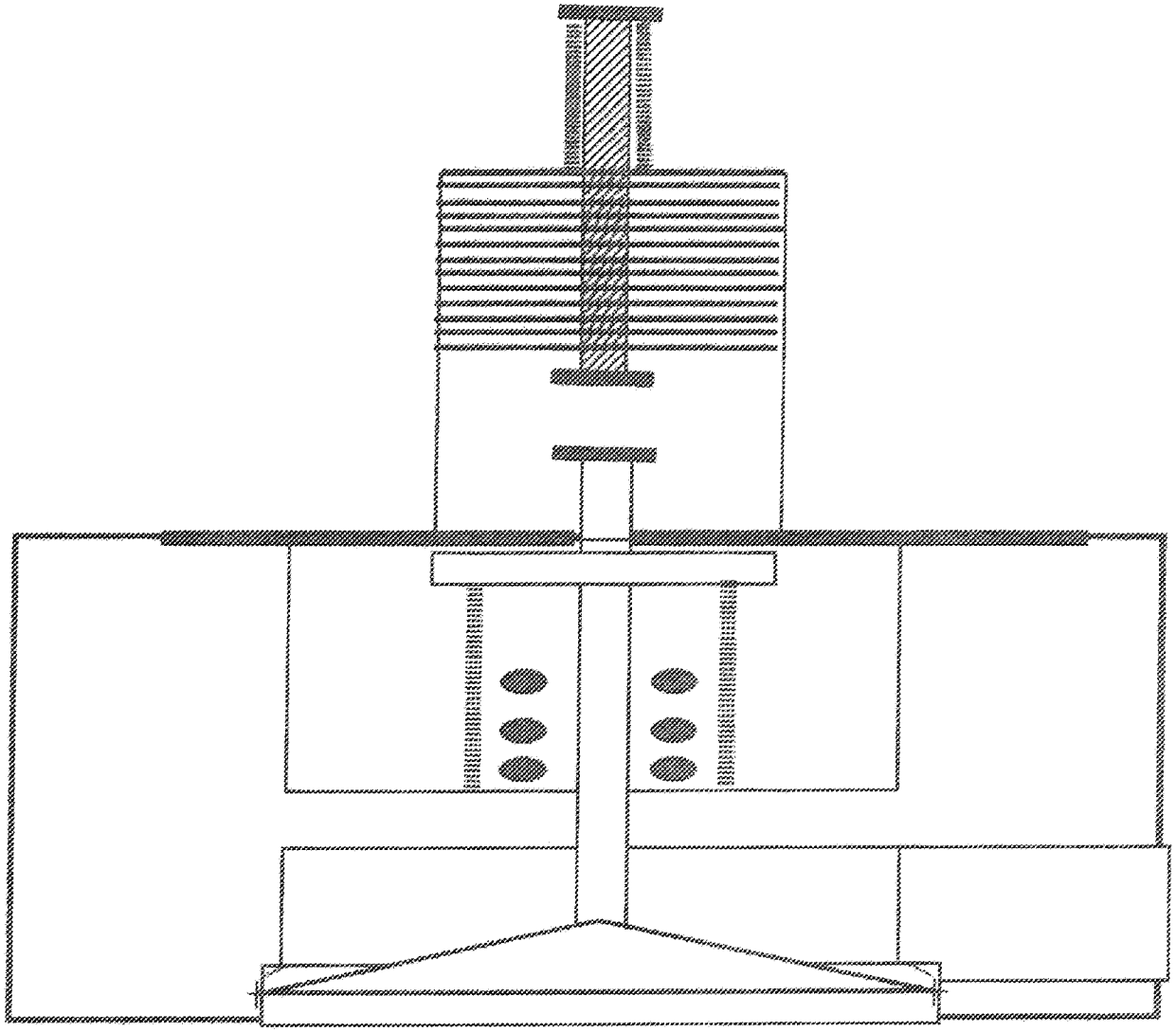

FIG. 8 to FIG. 14 basically show the same method as in FIG. 1 to FIG. 7, except that a short mechanical spring 4 is arranged in central space provided inside an outer mechanical spring 9. The spring 4 is substantially stiffer (stronger) and has a substantially greater spring constant than spring 9, which is shown as substantially less stiff (weaker). The purpose of this arrangement is to provide a significantly short duration. When the plunger hits the valve stem, as shown in FIG. 9, the distance 7 is eliminated and the engine valve moves at a substantially higher speed than when the corresponding occurs according to FIG. 2. When spring washer 8 strikes the spring 4, a major portion of the kinetic energy of the engine valve is transferred, FIG. 11, to spring 4 which brings the opening movement to quickly stop and turn the movement into a closing motion, FIG. 12. The engine valve can be said to bounce against spring 4, which does not necessarily, as shown here, need to be constituted by a mechanical spring, but can on the contrary be constituted by another type of spring.

In a first embodiment of a method for electrically controlling a valve actuator in a two-stroke or four-stroke combustion engine where the actuator comprises a solenoid (A), a plunger (5) and a spring (6), wherein the engine has at least one cylinder (1) with at least one freely controllable engine valve with a valve disc (10) with corresponding valve stem (11) and a valve spring (4) where a distance (7) is provided between the lower end of the plunger and the upper end of the valve stem, and where air is supplied or exhausts are evacuated from, a combustion chamber (3) past a lower part of the valve stem with the valve disc via at least one channel (2) in the cylinder, wherein the valve actuator is activatable to open the engine valve, wherein the method is characterized in that the opening of the engine valve is initiated after activation of the solenoid, wherein the following acceleration of the plunger brings its lower end to strike the upper end of the valve stem for initial opening of the valve.

In a second embodiment, a method according to the first embodiment is provided, further characterized in that the movement of the plunger continues until the movement is interrupted when the plunger reaches its stop in the solenoid, and that the opening movement of the engine valve continues until valve spring force brings the movement to stop, whereby the engine valve starts its return towards the valve seat.

In a third embodiment, a method according to the second embodiment is provided, further characterized in that the upper end of the valve shaft reaches the lower end of the plunger before the engine valve reaches the valve seat, whereby a braking of the closing movement arises.

In a fourth embodiment, a method according to the third embodiment is provided, further characterized in that, just before the engine valve reaches the valve seat, the solenoid is activated during a short adapted time to brake the movement of the engine valve such that the valve disc lands in the valve seat with a suitable speed, for instance a sufficiently high speed to keep the valve seat free from soot, while at the same time sufficiently low speed not to cause too much wear on the valve disc and the valve seat.

In a first embodiment of a device for electrically controlling a valve actuator in a two-stroke or four-stroke combustion engine and for carrying out the method according to the first embodiment of the method, the device is characterized in that the engine valve is configured to initially open after activation of the solenoid, whereby the following acceleration of the plunger brings its lower end to strike the upper end of the valve stem for initial opening of the valve.

In a second embodiment, a device according to the first embodiment is provided, further characterized in that a short mechanical spring (4) is arranged in a space in an outer mechanical spring (9), wherein the spring (4) has a substantially higher spring constant compared to the spring (9).

In a third embodiment, a device according to the first embodiment is provided, further characterized in that the spring (4) is substantially stiffer and has a substantially higher spring constant compared to the spring (9).

In a fourth embodiment, a device according to the second or third embodiment is provided, further characterized in that a spring washer (8) is arranged to strike the spring (4) for receiving the kinetic energy of the engine valve to the spring (4) for braking and turning of the movement into a closing movement.

The invention is not limited to the described embodiments, but modifications can be made within the scope of the following claims. Above described embodiments may furthermore be combined in any way.

The invention claimed is:

1. A method for electrically controlling a valve actuator in a combustion engine, wherein the valve actuator comprises a solenoid, a plunger and a plunger spring, wherein the plunger spring keeps the plunger in a home position when the solenoid is not activated, wherein the engine has at least one cylinder head with at least one engine valve comprising a valve disc, a valve stem, and a valve spring, wherein a distance is provided between a lower end of the plunger and an upper end of the valve stem, and wherein air is supplied to, or exhaust gases are evacuated from, a combustion chamber past a lower part of the valve stem and the valve disc via at least one channel in the at least one cylinder head, wherein the valve actuator is configured to open the at least one engine valve, the method comprising:

activating the solenoid such that the lower end of the plunger strikes the upper end of the valve stem so as to initiate an opening movement of the at least one engine valve, wherein:

movement of the plunger continues until the plunger reaches a stop in the solenoid, and the opening movement of the at least one engine valve continues while the upper end of the valve stem is separated from the lower end of the plunger and until a force from the valve spring stops the opening movement of the at least one engine valve and starts a closing movement of the at least one engine valve towards a valve seat.

2. The method of claim 1, wherein, during the closing movement of the at least one engine valve, the upper end of the valve stem reaches the lower end of the plunger before the at least one engine valve reaches the valve seat so as to impart a braking of the closing movement of the at least one engine valve.

3. The method of claim 2, further comprising activating the solenoid, just before the at least one engine valve reaches the valve seat, so as to brake the closing movement of the at least one engine valve and provide a soft return of the at least one engine valve to the valve seat.

4. A combustion engine comprising:

at least one cylinder head with at least one engine valve comprising a valve disc, a valve stem, and a valve spring, a combustion chamber configured to receive air or evacuate gases past a lower part of the valve stem and the valve disc via at least one channel in the at least one cylinder head, and a valve actuator comprising a solenoid, a plunger, and a plunger spring, wherein the plunger spring is arranged to keep the plunger in a home position when the solenoid is not activated, wherein:

a distance is provided between a lower end of the plunger and an upper end of the valve stem, the valve actuator is configured to open the at least one engine valve, the lower end of the plunger is configured to strike the upper end of the valve stem so as to initiate an opening movement of the at least one engine valve after activation of the solenoid, an opening movement of the plunger continues until the plunger reaches a stop in the solenoid, and the opening movement of the at least one engine valve continues after the plunger has reached the stop while the upper end of the valve stem is separated from the lower end of the plunger and until a force provided by the valve spring stops the opening movement of the at least one engine valve and starts a closing movement of the at least one engine valve towards a valve seat of the at least one engine valve.

5. The combustion engine of claim 4, wherein the valve spring comprises a short mechanical spring arranged in a central space of an outer mechanical spring, wherein the short mechanical spring has a higher spring constant than the outer mechanical spring.

6. The combustion engine of claim 5, wherein the short mechanical spring is stiffer than the outer mechanical spring.

7. The combustion engine of claim 5, wherein a spring washer is arranged to strike the short mechanical spring so as to transfer kinetic energy from the at least one engine valve to the short mechanical spring.

* * * * *